US005101709A

United States Patent [19]

Fujimoto

[11] Patent Number: 5,101,709

[45] Date of Patent: Apr. 7, 1992

[54] WATERPROOF COVER FOR A PNEUMATIC ACTUATOR

[75] Inventor: Tadayuki Fujimoto, Himeji, Japan

[73] Assignee: Mitsubishi Denki K.K., Tokyo, Japan

[21] Appl. No.: 638,591

[22] Filed: Jan. 8, 1991

[30] Foreign Application Priority Data

Jan. 10, 1990 [JP] Japan ..... 2-986[U]

[51] Int. Cl.[5] ..... F15B 13/044

[52] U.S. Cl. ..... 91/454; 91/459

[58] Field of Search ..... 91/449, 454, 459

[56] References Cited

U.S. PATENT DOCUMENTS

| | | | |
|---|---|---|---|
| 3,500,722 | 3/1970 | Franz et al. | 91/495 |
| 4,437,386 | 3/1984 | Baumgartner | 91/454 |
| 4,559,864 | 12/1985 | Sakakibara et al. | 91/454 |
| 4,756,234 | 7/1988 | Anderson | 91/454 |
| 4,799,418 | 1/1989 | Takahashi et al. | 91/454 |
| 4,889,033 | 12/1989 | Onishi et al. | 91/454 |

*Primary Examiner*—Edward K. Look
*Assistant Examiner*—F. Daniel Lopez
*Attorney, Agent, or Firm*—Sughrue, Mion, Zinn, Macpeak & Seas

[57] ABSTRACT

A pneumatic actuator comprising a housing asembly (1, 2) and a diaphragm (7) defining a diaphragm chamber (6) which is in communication with the exterior through an exhaust and a suction conduit (1*c*, 1*d*). Solenoid valves (8, 9*a*, 9*b*) for opening and closing the conduit (1*c*, 1*d*) are mounted to the housing (1) and are covered by an outer cover (10) attached to the housing (1). The housing (1) has a raised outer surface (1*e*) which is brought into contact with the cover (10) for substantially preventing ingress of moisture. The raised outer surface (1*e*) of the housing (1) also has a groove (13) for collecting and exhausting moisture passed through the clearance under the outer cover (1) by the capillary action.

6 Claims, 4 Drawing Sheets

WATERPROOF COVER FOR A PNEUMATIC ACTUATOR

BACKGROUND OF THE INVENTION

This invention relates to a pneumatic actuator and, more particularly, to a water proof structure for a pneumatic actuator for driving an external load drive wire which is used for controlling the degree of opening of an engine throttle valve.

FIG. 1 is a sectional view of a conventional pneumatic actuator to which the present invention pertains, and FIG. 2 is a partial sectional view taken along line II—II of FIG. 1.

In FIGS. 1 and 2, reference numeral 1 is a housing, 1*s* (FIG. 2) is a water proof side wall, 2 is an outer case, 3 is a connector fitting to which an external load drive wire (not illustrated) connected to an engine throttle valve (not illustrated) can be connected, 4 is a holding plate to which the connector fitting 3 is attached, 7 is a diaphragm which is securely attached at its outer periphery to the housing 1 or the outer case 2 and which is held at its central portion by the holding plates 4, 5 is a spring urging the holding plate 4 and the diaphragm 7 in the right hand direction in the figure, 6 is a diaphragm chamber defined by the housing 1 and the diaphragm 7, 8 is an air exhaust solenoid valve for opening and closing an exhaust conduit communicating the diaphragm chamber 6 to a vacuum source such as an engine air intake manifold (not shown), 9*a* and 9*b* are a pair of air intake solenoid valves for opening and closing air intake conduits communicating the diaphragm chamber 6 to a negative pressure source (not shown), 10 is an outer cover for protecting the exhaust solenoid valve 8 and the intake solenoid valves 9*a* and 9*b*, 11 is a plate for the solenoid valves, 12 is a clearance defined between an edge of the outer cover 10 and an outer circumferential surface of a valve mounting portion of the housing 1 and reference numeral 20 is a conduit communicating with the atmosphere.

When the pneumatic actuator as above described is used for controlling the degree of opening of the automobile throttle valve, the connector fitting 3 is connected to one end of an external load drive wire (not shown) connected to the throttle valve (not shown). In an accelerating mode, an external control unit (not shown) causes the exhaust solenoid valve 8 to open the negative pressure conduit. Then the negative pressure source such as an engine intake manifold (not shown) reduces the pressure within the diaphragm chamber 6, whereby the holding plate 4 and the connector fitting 3 are moved to the left in FIG. 1 against the action of the compression spring 5 to pull the external load drive wire (not shown) to open the engine throttle valve (not shown).

On the other hand, in a deceleration mode, the external control unit (not shown) causes the exhaust solenoid valve 8 to close the negative pressure conduit and causes the intake solenoid valves 9*a* and 9*b* to open the conduit communicated to the atmosphere. Then the pressure within the diaphragm chamber 6 becomes an atmospheric pressure, whereby the holding plate 4 and the connector fitting 3 are moved to the right in FIG. 1 by the action of the compression spring 5 to allow the external load drive wire (not shown) to return to close the engine throttle valve (not shown).

In the conventional pneumatic actuator, the outer cover 10 is mounted to the housing 1 so that its edge defining the opening extends horizontally and is spaced apart from the outer circumferential surface of the valve mounting portion of the housing 1 to define the substantially horizontally extending clearance 12 therebetween. In order to prevent water from entering into the interior of the outer cover 10, a solenoid valve mounting plate 11 having a width substantially closing the interior of the outer cover 10 is disposed between the valve mounting surface of the housing 1 and the solenoid valves 8, 9*a* and 9*b*.

However, in the conventional pneumatic actuator, water drops on the actuator from above is led to flow through the clearance 12 defined between the housing 1 and the outer cover 10 surrounding the solenoid valves 8, 9*a* and 9*b*, so that the water resistance is not very high.

SUMMARY OF THE INVENTION

Accordingly, one object of the present invention is to provide a pneumatic actuator free from the above-discussed problems of the conventional pneumatic actuator.

Another object of the present invention is to provide a pneumatic actuator which has an improved water resistivity.

Another object of the present invention is to provide a pneumatic actuator which has an improved water resistivity and is still simple in structure.

With the above objects in view, the pneumatic actuator of the present invention comprises a housing having a suction conduit and an exhaust conduit. A diaphragm is disposed in the housing to define a diaphragm chamber therein which is in communication with the suction conduit and the exhaust conduit. In order to open and close the conduits, solenoid valves are mounted to the housing and the solenoid valves are covered by an outer cover attached to the housing. The housing has a raised outer surface which is brough in contact with the cover at an inner surface thereof for substantially preventing ingress of moisture. The raised outer surface of the housing also has formed therein a groove for collecting and exhausting moisture passed through the clearance under the outer cover.

According to another aspect of the present invention, the pneumatic actuator may comprise a housing assembly including a housing and an external case which, together with a diaphragm, defines a diaphragm chamber. The diaphragm has a movable front end to which a holding plate connectable to an external mechanism is attached. The housing has an air intake conduit and an exhaust conduit communicating the diaphragm chamber to the atmosphere and a vacuum source such as an engine manifold, respectively. In order to selectively open and close the conduits, an intake solenoid valve and an exhaust solenoid valve are mounted to the housing and surrounded by a cover attached to the housing for covering the solenoid valves. The housing has an upper portion thereof in contact with the cover to define substantially no clearance between the upper portion of the housing and the cover for preventing the ingress of moisture, and the housing having a groove formed in the upper portion of the housing for collecting any moisture entered through the clearance due to the capillary action.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
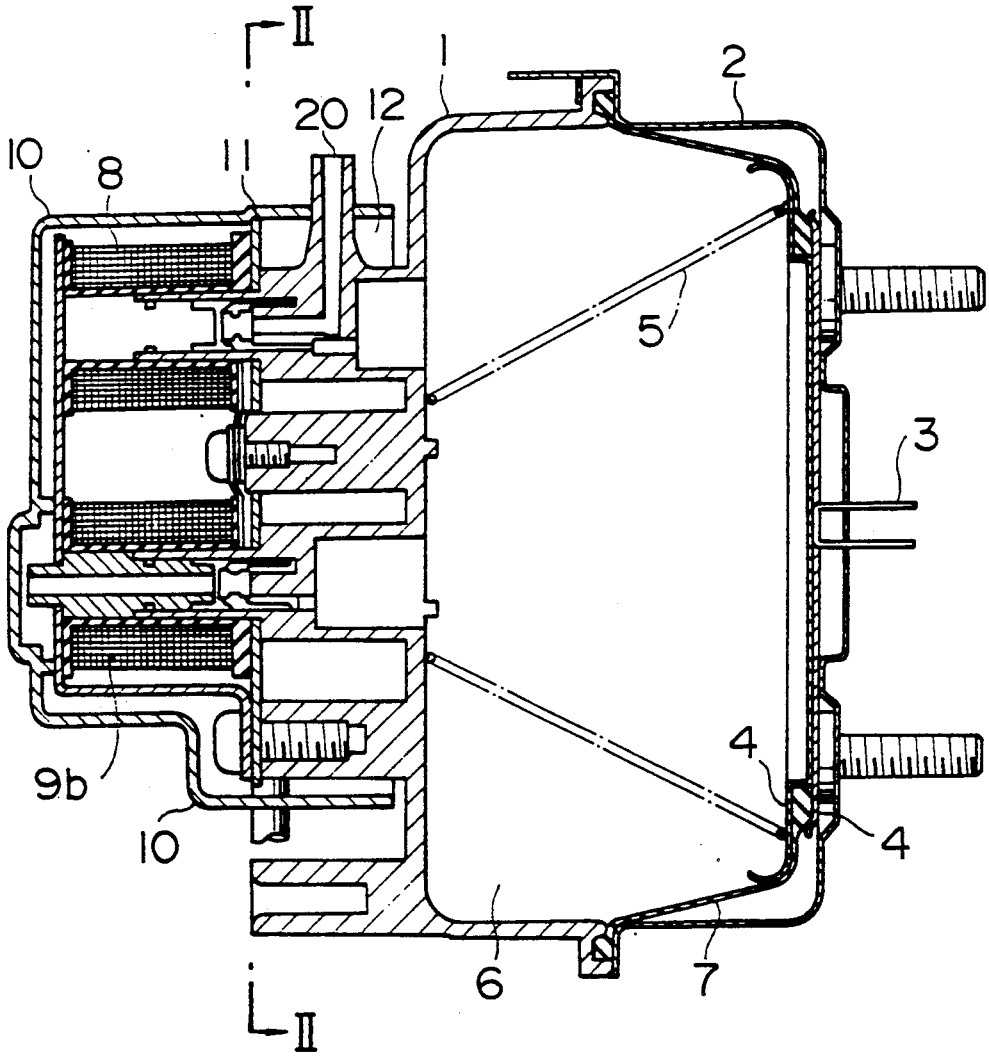
FIG. 1 is a sectional side view of a conventional pneumatic actuator taken substantially along line I—I of FIG. 2.
Figure 2:
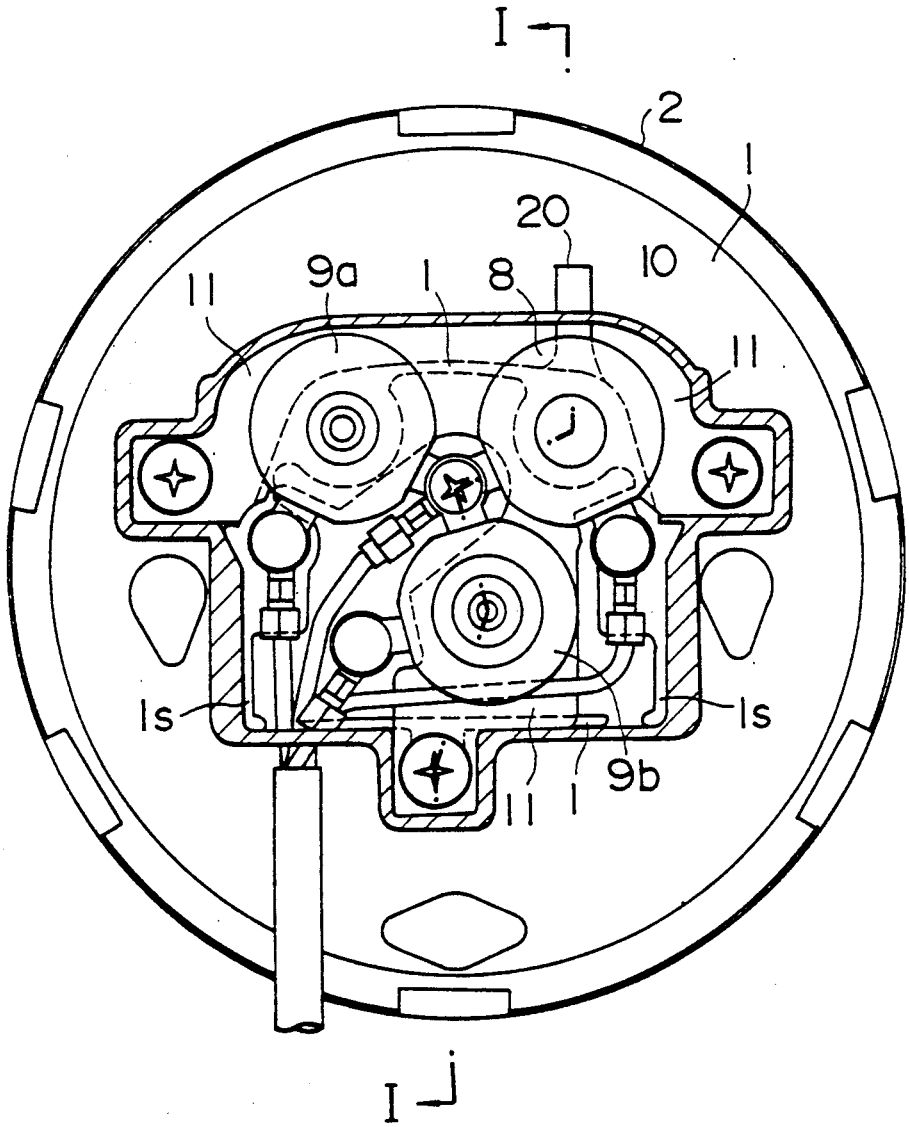
FIG. 2 is a partial sectional view taken substantially along line II—II of FIG. 1.
Figure 3:
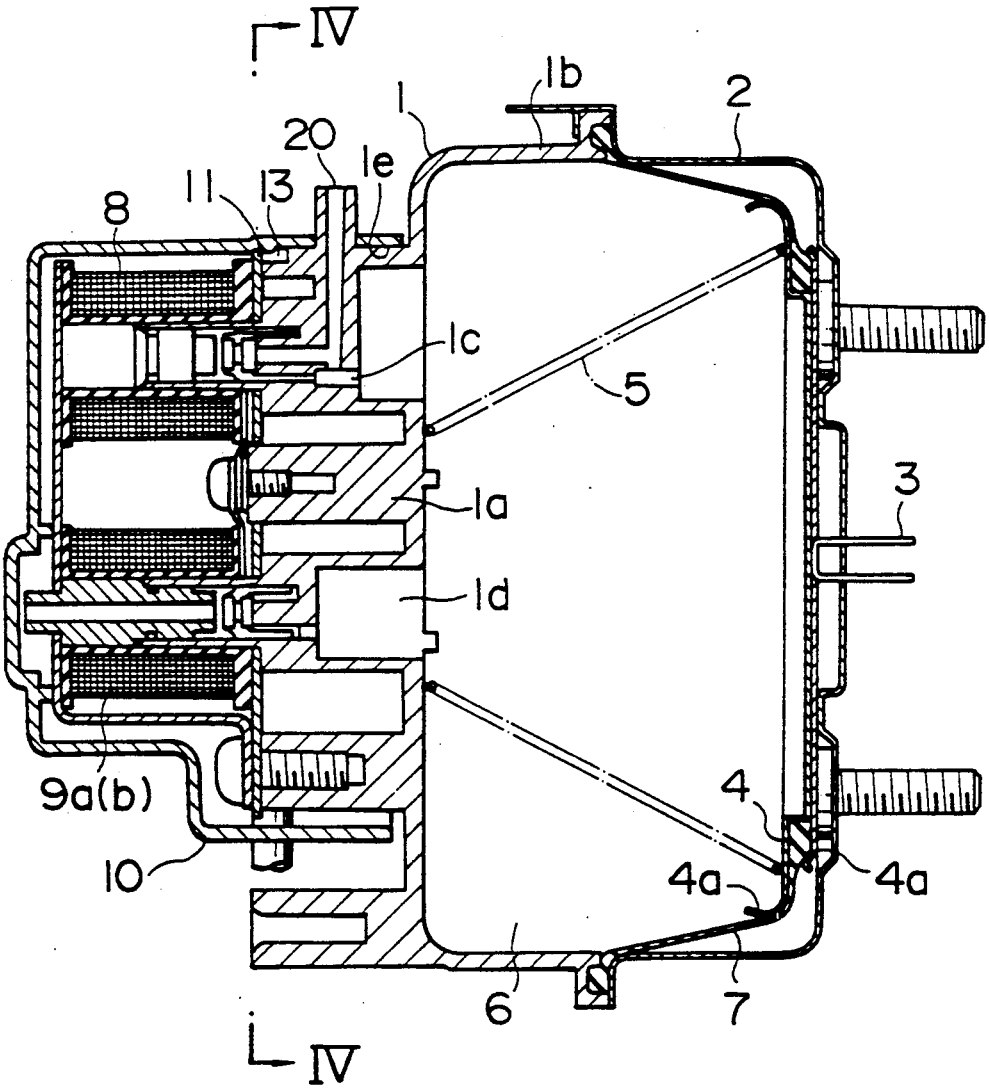
PRIOR ART FIG. 3
FIG. 3 is a sectional side view of the pneumatic actuator of the present invention taken substantially along line III—III of FIG. 4.
Figure 4:
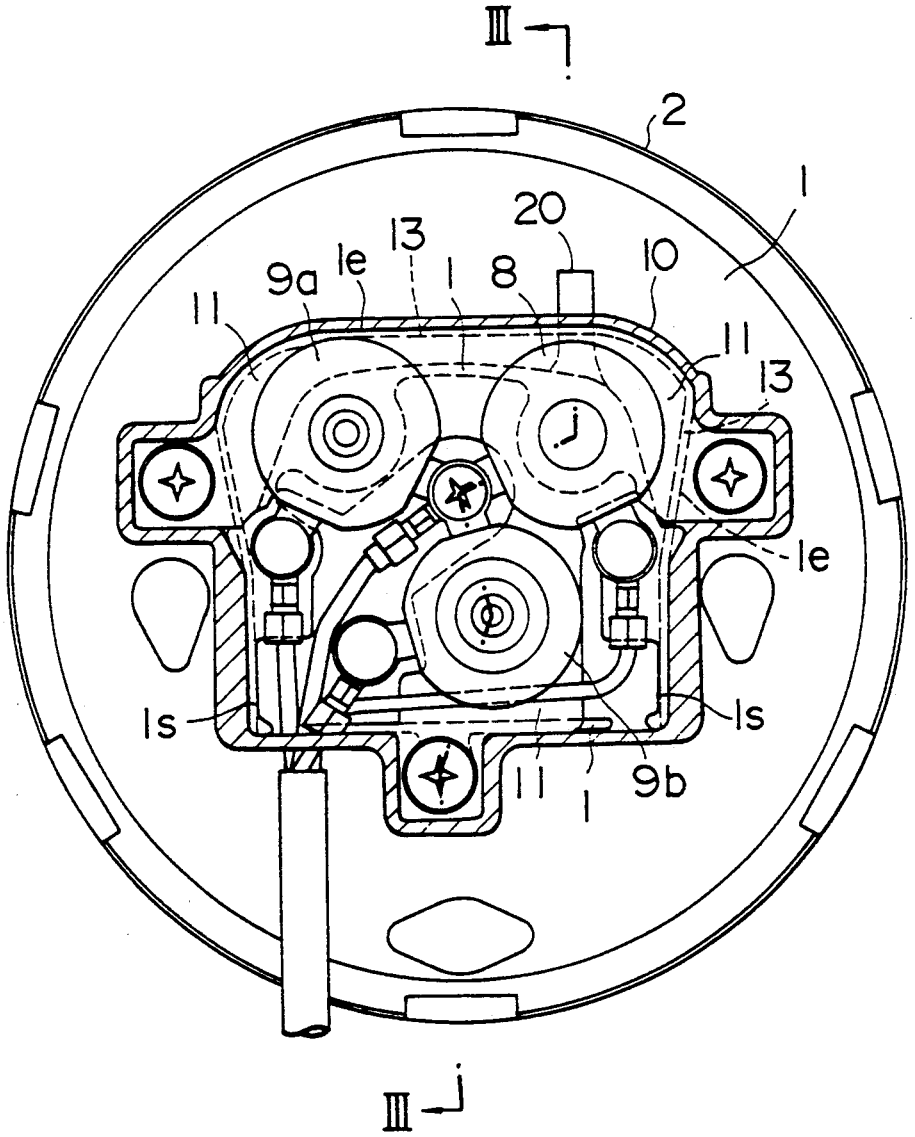
PRIOR ART FIG. 4
FIG. 4 is a partial sectional view taken substantially along line IV—IV of FIG. 3.

FIGS. 3 and 4 illustrate the pneumatic actuator of the present invention, which comprises a housing assembly including a housing 1 and an external case 2. The housing 1 has a valve-mounting portion 1*a* and cup-shaped portion 1*b*, the valve-mounting portion 1*a* projecting from the outer surface of the bottom wall of the cup-shaped portion 1*b*. The valve-mounting portion 1*a* has formed therein an exhaust conduit 1*c* and suction conduits 1*d* which extend through the valve-mounting portion 1*a*.

Within the housing assembly, a substantially cup-shaped diaphragm 7 is disposed within the housing assembly to define therein a diaphragm chamber 6 which is in communication with the exhaust conduit 1*c* and the suction conduits 1*d* of the housing 1. The open end or the outer peripheral edge of the cup-shaped diaphragm 7 is securely and hermetically held between the mating ends of the housing 1 and the external case 2. Central portion or a bottom wall portion of the cup-shaped diaphragm 7 is sandwiched and hermetically held between a pair of flanges 4*a* of a disc-shaped holding plate 4. Thus, the diaphragm chamber 6 is communicated to the exterior only through the conduits 1*c* and 1*d*. The holding plate 4 has securely attached on an outer surface thereof a connector 3 to which an output wire (not shown) for operating a throttle valve (not shown) can be connected. It is seen that a compression spring 5 is disposed between the holding plate 4 and the housing 1 so that the holding plate 4 is always biased toward the external case 2 to urge the diaphragm chamber 6 to the expanded position.

The pneumatic actuator also comprises an intake solenoid valve 8 mounted to the valve-mounting portion 1*a* of the housing 1 through a valve mounting plate 11 and having a valve member disposed within the exhaust conduit 1*c* for opening and closing the conduit 1*c*, and exhaust and solenoid valves 9*a* and 9*b* mounted to the valve-mounting portion 1*a* of the housing 1 through the valve mounting plate 11 and having valve members disposed within the respective suction conduits 1*d* for opening and closing the conduits 1*d*. The solenoid valves 8, 9*a* and 9*b* are surrounded by a cover 10 attached to the housing 1. The cover 10 may be attached to the housing 1 by being snap-fitted to an outer edge of the valve mounting plate 11. It is seen that one end of the suction conduit 1*c* opens to the diaphragm chamber 6 and the other end terminates at the exterior at a radially outwardly projecting connecting tube 20 which may be connected to an engine air intake manifold (not shown). The valve member of the solenoid valve 8 is disposed between both ends of the conduit 1*c*. The suction conduit 1*d* each has its one end opening to the diaphragm chamber 6 and the other end of the conduit 1*d* extends through a core of the solenoid valve 9*a* or 9*b* and opens within the cover 10 placed over the solenoid valves 8, 9*a* and 9*b* to surround them for protection. The interior of the cover 10 is communicated to the atmosphere through a clearance defined substantially between the solenoid valve mounting portion 1*a* of the housing 1 by the open edge of the cover 10.

According to the pneumatic actuator of the present invention, the valve-mounting portion 1*a* of the housing 1 has a raised outer surface 1*e* which is in contact with an inner surface of open end of the cover 10 over a relatively large area in order that the ingress of moisture through the clearance between the cover 10 and the surface 1*e* of the valve-mounting portion 1*a* is substantially prevented. This raised outer surface 1*e* extends substantially circumferentially over a distance sufficient to prevent ingress of moisture. In the illustrated embodiment, as best seen from FIG. 4, the raised outer surface 1*e* substantially extends upwardly from an outer surface of one of the side walls 1*s* of the valve mounting portion 1*a* of the housing 1 to reach to the inner surface of the cover 10 from where it further extends along the inner surface of the cover 10 and bends downwardly to reach the other side wall 1*s*.

It is also seen that a drain groove 13 is formed in the raised surface 1*e* for collecting and exhausting moisture that flows to this area through the clearance between the cover 10 and the surface 1*e* of the valve-mounting portion 1*a*. In the illustrated embodiment, one side wall of the groove 13 is defined by a radial wall defining a step, the bottom wall of the groove 13 is defined by an circumferential surface, and the other side wall is defined by the mounting plate 11. Alternatively, the drain groove 13 may be defined by a groove integrally formed in the raised outer surface 1*e*. As seen from FIG. 4, the drain groove 13 extends over the entire circumferential dimension of the raised surface portion 1*e* of the valve-mounting portion 1*a* of the housing 1.

Thus, even when water drops on the pneumatic actuator of the present invention, substantially all of the water is prevented from entering into the interior of the actuator because the cover 10 intimately overlaps the raised upper surface 1*e* of the valve-mounting portion 1*a* of the housing 1 and substantially no clearance is provided therebetween. While some moisture may be enter into the housing interior along the surface 1*e* because of the capillary action of the contact interface between the cover 10 and the housing 1, such moisture is collected within the drain groove 13 and led to proceed circumferentially to side portions of the housing 1, where the moisture cannot enter into the interior of the actuator.

What is claimed is:

1. A pneumatic actuator comprising:

a housing having an exhaust conduit, a suction conduit and a valve mounting portion having a plurality of side walls;

a diaphragm disposed in said housing to define a diaphragm chamber therein in communication with said suction conduit and said exhaust conduit;

solenoid valves attached to said housing for opening and closing said conduits; and a cover placed over said solenoid valves to surround said solenoid valves;

said housing comprising means for preventing ingress of moisture into said actuator, said means comprising a raised outer surface in contact with an inner surface of an open end of said cover for substantially preventing ingress of moisture and a groove formed in said raised outer surface for collecting and exhausting moisture therefrom, wherein said raised outer surface extends substantially upwardly from an outer surface of a first side wall to reach and extend along an inner surface of said cover and is curved to reach a second side wall of said valve mounting portion.

2. A pneumatic actuator as claimed in claim 1, wherein said raised outer surface extends substantially circumferentially over a distance sufficient to prevent ingress of moisture.

3. A pneumatic actuator as claimed in claim 2, wherein said groove is integrally formed in a substantially circumferential direction thereof for collection of water.

4. A pneumatic actuator comprising:

a housing assembly including a housing, an external case and a valve mounting portion having a plurality of side walls;

a diaphragm disposed within said housing assembly to define, together with said housing assembly, a diaphragm chamber, said diaphragm having a front end to which a holding plate connectable to an external mechanism is attached, and said front end being axially movable back and forth;

said housing having an air exhaust conduit and an air intake conduit each communicating said diaphragm chamber to the exterior thereof;

an exhaust solenoid valve and an intake solenoid valve mounted to said housing for selectively opening and closing said conduits; and a cover attached to said housing for covering said solenoid valves;

said housing comprising means for preventing ingress of moisture into said actuator, said means comprising an upper portion of said housing in contact with said cover to define a point of contact between said upper portion of said housing and said cover for preventing the ingress of moisture, said housing including a groove formed in said upper portion of said housing for collecting moisture entering through said point of contact between said housing and said cover, wherein said upper portion of said housing extends substantially upwardly from an outer surface of a first side wall to reach and extend along an inner surface of said cover and is curved to reach a second side wall.

5. A pneumatic actuator as claimed in claim 4, wherein said groove is defined by a groove integrally formed in said upper surface portion of the housing.

6. A pneumatic actuator as claimed in claim 4, wherein said groove is defined by a stepped portion of the housing and a valve mounting plate.

* * * * *